US007010264B1

(12) United States Patent
Nguyen et al.

(10) Patent No.: US 7,010,264 B1
(45) Date of Patent: Mar. 7, 2006

(54) SYSTEM AND METHOD FOR DETECTING THE CONNECTIONS OF TWO ANTENNAE TO A RADIO RECEIVER

(75) Inventors: Anh Nguyen, Boynton Beach, FL (US); Argy Petros, Lake Worth, FL (US)

(73) Assignee: XM Satellite Radio, Washington, DC (US)

( * ) Notice: Subject to any disclaimer, the term of this patent is extended or adjusted under 35 U.S.C. 154(b) by 617 days.

(21) Appl. No.: 09/931,101

(22) Filed: Aug. 17, 2001

(51) Int. Cl.
*H04H 1/00* (2006.01)

(52) U.S. Cl. ..... 455/3.02; 455/269; 343/893

(58) Field of Classification Search ..... 343/715, 343/876, 725; 455/277; H04B 17/00
See application file for complete search history.

(56) References Cited

U.S. PATENT DOCUMENTS

| | | | | |
|---|---|---|---|---|
| 4,525,869 | A * | 6/1985 | Hamada et al. | 455/277.2 |
| 5,216,434 | A * | 6/1993 | Fukumura | 343/876 |
| 6,252,551 | B1 * | 6/2001 | Noro et al. | 343/700 |
| 6,329,954 | B1 * | 12/2001 | Fuchs et al. | 343/725 |
| 6,538,611 | B1 * | 3/2003 | Noro | 343/725 |
| 2004/0032373 | A1 * | 2/2004 | Petros et al. | 343/725 |

FOREIGN PATENT DOCUMENTS

| | | | |
|---|---|---|---|
| JP | 04233837 A | * | 8/1992 |
| JP | 2797715 | | 9/1998 |

* cited by examiner

*Primary Examiner*—Fan Tsang
*Assistant Examiner*—Lisa Hashem
(74) *Attorney, Agent, or Firm*—Pillsbury Winthrop Shaw Pittman LLP

(57) ABSTRACT

A system and method for confirming that two antennae are connected to a radio receiver. There is provided a radio receiver including a signal generating source, a first antenna feed connection port, a second antenna feed connection port, and a signal detection circuit. Also provided is a low noise amplifier (LNA) module having a first LNA and a second LNA, wherein the first LNA is in communication with a first antenna and the second LNA is in communication with a second antenna, and wherein outputs of the first and second LNAs are in communication, respectively, with the first antenna feed connection port and the second antenna feed connection port. A DC signal pathway is established, at least in part, through the LNA module and electrically connects the signal generating source and the signal detection circuit to each other, whereby when the signal is detected it can be confirmed that both antennae are connected to the radio receiver.

27 Claims, 2 Drawing Sheets

SYSTEM AND METHOD FOR DETECTING THE CONNECTIONS OF TWO ANTENNAE TO A RADIO RECEIVER

BACKGROUND

1. Field of the Invention

The present invention is directed to connection detection. More particularly, the present invention is directed to detecting whether two antennae are properly connected to a receiver, whereby more reliable reception of a broadcast can be ensured.

2. Background of the Invention

Satellite radio operators will soon provide digital quality radio broadcast services covering the entire continental United States. These services will offer approximately 100 channels, of which nearly 50 channels will provide music, with the remaining channels offering news, sports, talk and data.

Satellite radio has the ability to improve terrestrial radio's potential by offering better audio quality, greater coverage and fewer commercials. In October of 1997, the Federal Communications Commission (FCC) granted two national satellite radio broadcast licenses. The FCC allocated 25 megahertz (MHz) of the electromagnetic spectrum for satellite digital broadcasting, 12.5 MHz of which are now owned by Sirius Satellite Radio, New York, N.Y. and 12.5 MHz of which are now owned by XM Satellite Radio Inc., Washington, D.C.

In deploying satellite radio, one system plan calls for transmission of program content from two or more geosynchronous or geostationary satellites to both mobile and fixed receivers on the ground. In urban canyons and other high population density areas with limited line-of-sight (LOS) satellite coverage, terrestrial repeaters will broadcast the same program content in order to improve coverage reliability. Mobile receivers, in particular, will preferably be capable of simultaneously receiving signals from at least one satellite and one terrestrial repeater for combined spatial, frequency and time diversity, thereby providing significant mitigation of multipath interference and addressing reception issues associated with complete or intermittent blockage of the satellite signals. Further in accordance with this particular scheme, the 12.5 MHz band is split into 6 slots. In a preferred allocation of slots, four slots are used for satellite transmission and two slots are used for terrestrial reinforcement.

In view of the desirability to obtain the highest quality radio reception, especially in radios mounted in moving vehicles, two antennae are preferably employed to receive the broadcast radio signal: one antenna for the satellite signal and another antenna for the terrestrial signal. From a consumer point of view, however, it is important that there be a positive indication that both antennae are indeed connected to the radio receiver so that the consumer and radio broadcast service provider can be assured that the best reception is being obtained.

SUMMARY OF THE INVENTION

It is therefore an object of the present invention to provide a method and system of ensuring that two broadcast reception antennae are connected to a receiver.

It is a further object of the present invention to provide a circuit that indicates whether two antennae are properly connected to a circuit module such as a receiver.

It is yet another object of the present invention to provide a positive indication of antenna connection while two antennae are connected to a common piece of equipment.

It is another object of the present invention to provide a loop back DC circuit that employs a non-grounded conductor of an antenna cable for a circuit path.

It is still another object of the present invention to provide a transistor circuit for determining the presence of a signal that has been looped through a circuit module.

It is another object of the present invention to provide a loop back circuit employing the non-grounded conductors of two antennae.

It is also an object of the present invention to provide a loop back circuit that returns an inbound connection detection signal that is different from an outbound connection detection signal.

These and other objects are achieved by an antenna connection detection system that employs a loop back circuit. More specifically, a receiver includes a first antenna connection port and a second antenna connection port. A first antenna (e.g., a satellite broadcast reception antenna) and a second antenna (e.g., a terrestrial broadcast reception antenna) are each connected to respective low noise amplifiers (LNAs) that are preferably housed together in a single module (an LNA module). Outputs of the respective LNAs from the LNA module are connected, via separate leads, to the first and second antenna connection ports on the receiver.

The receiver preferably applies a DC voltage signal to the non-grounded, or hot, conductor of the lead connected to the first antenna connection port. This DC voltage signal is preferably looped through the LNA module by following the non-grounded conductor of the lead that is connected to the second antenna connection port on the receiver. That is, a DC voltage signal is preferably superimposed on the satellite antenna feed coming from one LNA and is looped back on the terrestrial antenna feed coming from the other LNA so that the DC voltage signal's presence can be detected. A transistor circuit, for example, is connected to the second antenna connection port of the receiver and is arranged to detect the presence of the DC voltage signal that is applied at the first antenna connection port. In a preferred embodiment of the present invention, the DC voltage is used to power the LNAs in the LNA module.

In a preferred implementation of the present invention, feeds from the first and second antennae are joined to the LNA module. Accordingly, when the DC voltage signal is detected at the second antenna connection port, it can be confirmed that both antennae are indeed connected to the receiver. If one of the antennae were not connected to the receiver, the transistor circuit would not detect a looped-back voltage signal.

In another embodiment of the present invention, the DC voltage signal that is applied to the first connection port is regulated within the LNA module and the regulated DC voltage signal is looped back, or returned, to the second connection port for detection.

The details of the present invention will become more apparent upon a reading of the following detailed description in conjunction with the accompanying drawings.

DETAILED DESCRIPTION OF THE INVENTION

As previously described, in a direct radio broadcast system radio reception can be improved, under certain circumstances, by combining the reception of both a satellite and terrestrial signal. Accordingly, to positively confirm that two antennae are in fact connected to the receiver and thereby assure the best possible reception, the present inventors developed a new and unique antenna connection detection scheme.

Figure 1:
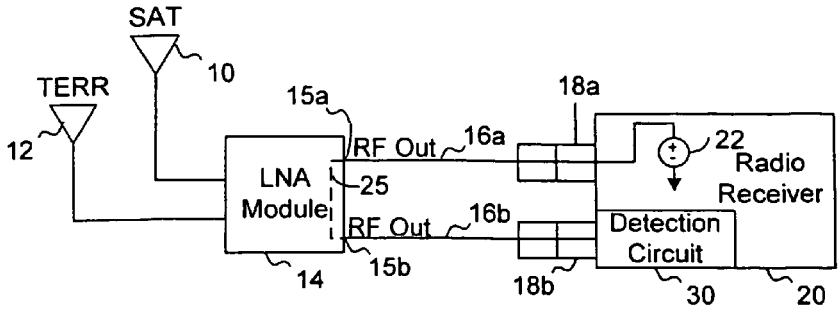
FIG. 1 is a schematic diagram of an exemplary antenna/receiver interface in accordance with the present invention.

In a preferred embodiment of the present invention, as shown in FIG. 1, a satellite antenna 10 and a terrestrial antenna 12 are each connected to a low noise amplifier (LNA) module 14 that comprises an LNA 14*a*, 14*b* for each received signal, i.e., satellite and terrestrial. The RF outputs of the LNA module are connected to respective jacks or connection ports 18*a*, 18*b* on radio receiver 20 via respective RF cables, or leads, 16*a*, 16*b*. Also as shown, a source of DC voltage 22, e.g., between 3.6 and 5 volts, is applied through the satellite connection port 18*a* and the terrestrial antenna connection port 18*b* is arranged to receive a "looped back" voltage signal via LNA module 14. In the context of the present invention, the looped back voltage signal (or simply "signal") is substantially the same voltage applied at the satellite antenna connection port 18*a* (except for, e.g., a diode voltage drop), or is a relatively lower (e.g., regulated) voltage signal. Thus, in the following description and claims, the "signal" used for detecting connection, refers to both the originally-generated signal and any modified version of that signal due to well-understood voltage drops that can occur in the circuits described herein.

Figure 2:
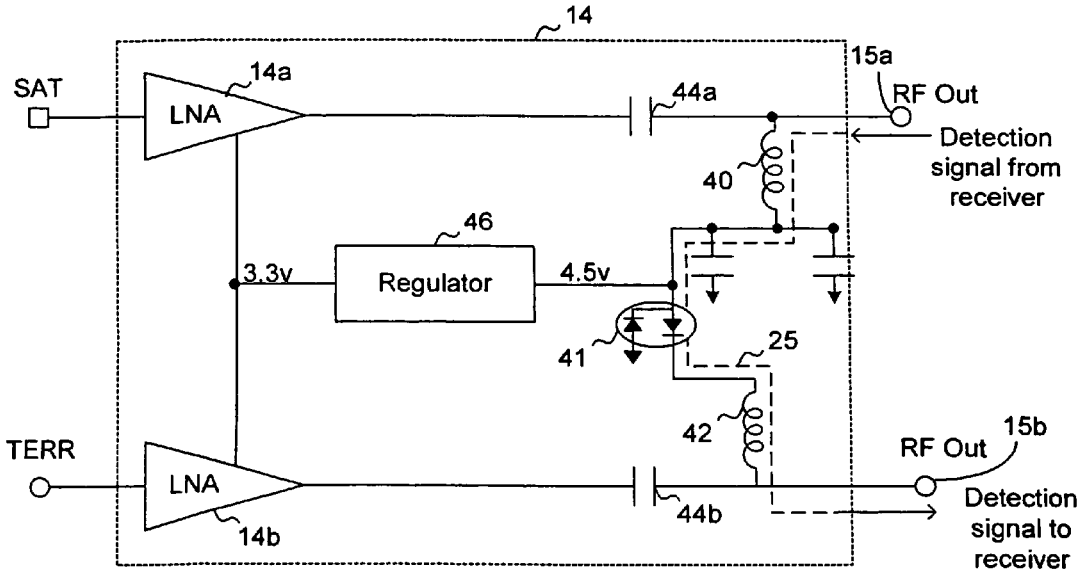
FIG. 2 is a schematic diagram of an exemplary LNA module and loop-back pathway in accordance with the present invention.

FIG. 2 illustrates a more detailed schematic drawing of an exemplary LNA module 14 in accordance with the present invention. As will be explained, the circuit shown in FIG. 2 provides a DC voltage loop-back path 25, which is used in the DC antenna detection system of the present invention. As shown, a detection signal (e.g., a voltage signal from source 22) from radio receiver 20 is applied to RF choke 40. The DC signal passes through RF choke 42 where it is fed back to radio receiver 20 through the terrestrial RF out 15*b*. Capacitors 44*a* and 44*b* are DC blocking capacitors. In this case, the voltage signal that is passed from the satellite "RF out" 15*a* to the terrestrial "RF out" 15*b* of LNA module 14 is unregulated. A diode pair 41 is preferably provided along path 25 to prevent damage to the circuitry in the event of an unintended voltage signal being applied to the loop-back circuit.

FIG. 2 also shows voltage regulator 46, which provides a regulated DC voltage signal to the two LNAs 14*a*, 14*b*, based on the applied voltage signal from receiver 20. Each LNA 14*a*, 14*b* is preferably powered by this regulated voltage.

Figure 3:
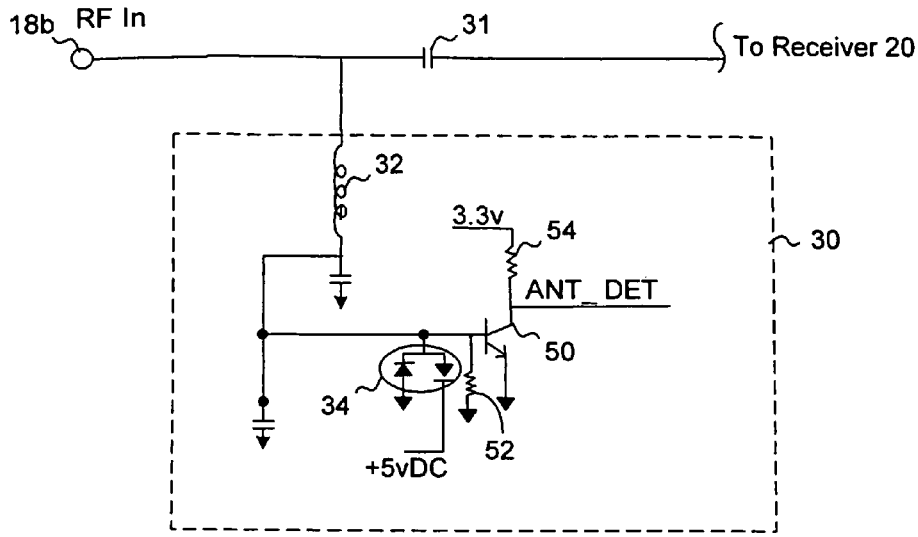
FIG. 3 is a schematic diagram of an exemplary transistor circuit for detecting the presence of a detection signal in accordance with the present invention.

A detection circuit 30 is shown in FIG. 3 and comprises an RF choke 32 that is connected between NPN transistor 50 and antenna connection port 18*b* (labeled "RF in"). Due to blocking capacitor 31, the looped-back voltage signal that has passed through LNA module 14 is thus applied to the base of transistor 50. A diode pair 34 is preferably provided for static protection. One of the diodes in the pair is preferably tied to 5 volts DC and the other one is preferably tied to ground thereby providing a bypass for positive or negative electrostatic discharge (ESD).

Detection circuit 30 operates as follows: if one of the RF outputs 15*a*, 15*b* of LNA module 14 is not in communication with radio receiver 20, then the voltage at the base of transistor 50 is zero due to resistor 52 that ties the base of transistor 50 to ground. Thus, if one of the outputs of LNA module 14 is not connected to radio receiver 20, transistor 50 does not conduct and a signal, "ANT_DET," is pulled to an applied 3.3 volts through resistor 54.

On the other hand, when both outputs of LNA module 14 are connected to radio receiver 20, then transistor 50 conducts and this state causes the ANT_DET signal to be pulled down to zero volts. Thus, when ANT_DET is measured to be zero volts it can be confirmed that both antennae are connected (via LNA module 14) to radio receiver 20. The ANT_DET signal can be employed to trigger a visual and/or audible notification of the state of antenna connection.

Figure 4:
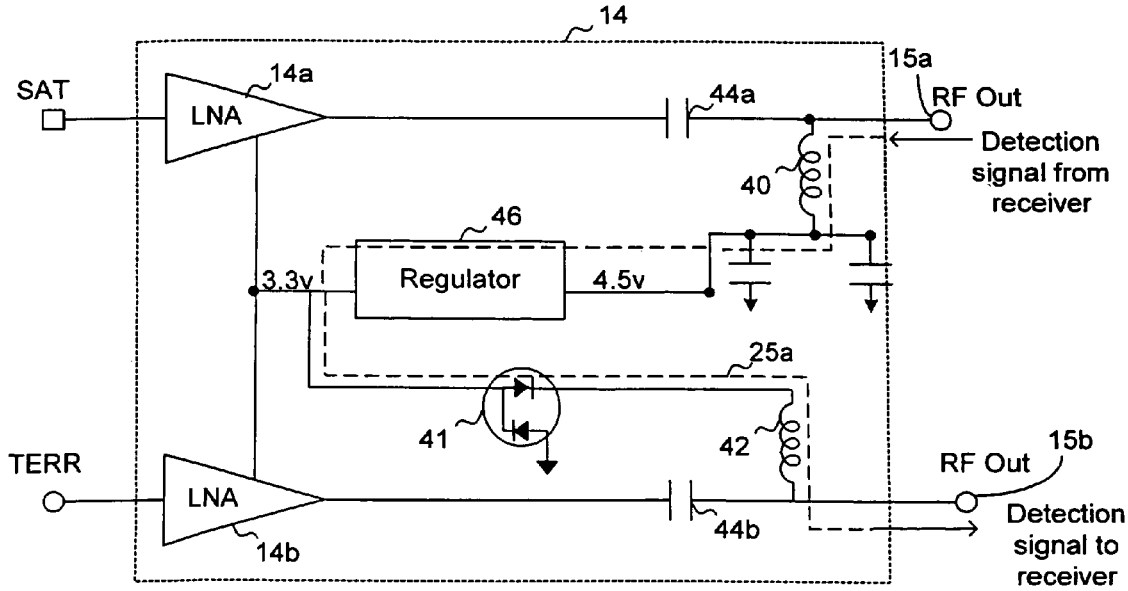
FIG. 4 depicts an alternative embodiment in which a regulated voltage is looped back to a radio receiver.

In an alternative embodiment, as shown in FIG. 4, the output of regulator 46 is looped back to radio receiver 20 via path 25*a*. Thus, as can be readily appreciated by those skilled in the art, not only can the loop-back circuit of the present invention be used to determine whether two antennae are connected to a radio receiver, but the inventive circuit can also be used to detect whether LNA module 14 is connected and/or whether the LNA module's voltage regulator is generating an output signal.

Finally, while the several components of the present invention have been grouped in LNA module 14 or radio receiver 20, the several components need not be necessarily be grouped in this fashion.

The foregoing disclosure of the preferred embodiments of the present invention has been presented for purposes of illustration and description. It is not intended to be exhaustive or to limit the invention to the precise forms disclosed. Many variations and modifications of the embodiments described herein will be obvious to one of ordinary skill in the art in light of the above disclosure. The scope of the invention is to be defined only by the claims appended hereto, and by their equivalents.

Further, in describing representative embodiments of the present invention, the specification may have presented the method and/or process of the present invention as a particular sequence of steps. However, to the extent that the method or process does not rely on the particular order of steps set forth herein, the method or process should not be limited to the particular sequence of steps described. As one of ordinary skill in the art would appreciate, other sequences of steps may be possible. Therefore, the particular order of the steps set forth in the specification should not be construed as limitations on the claims. In addition, the claims directed to the method and/or process of the present invention should not be limited to the performance of their steps in the order written, and one skilled in the art can readily appreciate that the sequences may be varied and still remain within the spirit and scope of the present invention.

What is claimed is:

1. An antenna connection detection system for confirming connections of two antennae to a radio receiver, comprising:

a receiver having a first antenna connection port and a second antenna connection port;

a first antenna and a second antenna; and a circuit via which the first and second antennae are in communication with the receiver, wherein the receiver supplies a first voltage signal to the first antenna connection port and detects whether a second voltage signal is present at the second antenna connection port, thereby confirming that both the first and second antennae are connected to the radio receiver, wherein the circuit comprises a low noise amplifier (LNA) module located between the first and second antennae and the receiver, and wherein the circuit further comprises a voltage regulator that provides a regulated voltage to the LNA module, the regulator being powered by the first voltage signal.

2. The system of claim 1, wherein the first antenna is a satellite broadcast reception antenna and the second antenna is a terrestrial broadcast reception antenna.

3. The system of claim 1, wherein the LNA module comprises at least two low noise amplifiers and wherein the first and second antennae are in communication with respective low noise amplifiers.

4. The system of claim 1, wherein the circuit redirects the signal to the second antenna connection port.

5. The system of claim 1, further comprising a transistor circuit for detecting a presence of the signal.

6. The system of claim 5, wherein the transistor circuit is located in the radio receiver.

7. The system of claim 1, wherein the signal is a voltage signal.

8. The system of claim 1, further comprising means for indicating whether either the first or the second antenna is disconnected.

9. A system for detecting whether two antennae are connected to a receiver, comprising:

a first RF feed from a first antenna;

a second RF feed from a second antenna;

a signal generating source in communication with the first RF feed;

a signal detection circuit in communication with the second RF feed;

a DC pathway that includes the first and second RF feeds and electrically connects the signal generating source and signal detection circuit;

a low noise amplifier (LNA) module connected between the first and second antennae and the first and second RF feeds;

a voltage regulator providing a regulated voltage to the LNA module, wherein the voltage regulator is powered by the signal generating source.

10. The system of claim 9, wherein the first antenna is one of a satellite broadcast reception antenna and a terrestrial broadcast reception antenna.

11. The system of 10, wherein the second antenna is the other of a satellite broadcast reception antenna and a terrestrial broadcast reception antenna.

12. The system of claim 10, wherein the LNA module comprises a first LNA and a second LNA that are in communication with the first and second antennae, respectively, and wherein outputs of the first and second LNA are in communication, respectively, with the first and second antenna feeds.

13. The system of claim 10, wherein the signal generating source and signal detection circuit are located in the receiver.

14. The system of claim 10, wherein the signal detection circuit comprises a transistor.

15. The system of claim 10, further comprising a voltage regulator.

16. The system of claim 10, further comprising means for indicating whether either the first or the second antenna is disconnected.

17. A system for confirming that two antennae are connected to a radio receiver, comprising:

a radio receiver comprising a signal generating source, a first antenna feed connection port, a second antenna feed connection port, and a signal detection circuit;

a low noise amplifier (LNA) module comprising a first LNA and a second LNA, wherein the first LNA is in communication with a first antenna and the second LNA is in communication with a second antenna, and wherein outputs of the first and second LNAs are in communication, respectively, with the first antenna feed connection port and the second antenna feed connection port; and a signal pathway that passes, at least in part, through the LNA module and electrically connects the signal generating source and the signal detection circuit to each other; and a regulator providing a regulated voltage to the LNA module, the regulator being powered by the signal generating source.

18. The system of claim 17, wherein the LNA module further comprises a voltage regulator.

19. The system of claim 17, wherein the signal generating source comprises a source of voltage.

20. The system of claim 17, wherein the signal detection circuit comprises a transistor circuit.

21. The system of claim 17, wherein the first antenna is one of a satellite broadcast reception antenna and a terrestrial broadcast reception antenna.

22. The system of 21, wherein the second antenna is the other of a satellite broadcast reception antenna and a terrestrial broadcast reception antenna.

23. The system of claim 17, wherein the signal path way comprises a diode.

24. A method of detecting antennae connection, comprising the steps of:

supplying a detection signal to a first antenna connection port;

routing said detection signal through a first antenna feed line;

returning a signal corresponding to said detection signal through a second antenna feed line;

detecting a presence of said signal corresponding to said detection signal at a second antenna connection port; and supplying power to a regulator that provides a regulated voltage to a low noise amplifier (LNA) module associated with at least one antenna, the regulator receiving power from said detection signal.

25. The method of claim 24, wherein the LNA module comprises a first LNA and a second LNA, and wherein outputs of the first and second LNAs are connected, respectively, the first antenna connection port and the second antenna connection port.

26. The method of claim 24, further comprising utilizing the detection signal as a power source for at least one low noise amplifier (LNA).

27. The method of claim 24, further comprising generating an indication of whether the detection signal is detected at the second antenna connection port.

* * * * *